US006904900B2

(12) United States Patent
Gallops, Jr.

(10) Patent No.: US 6,904,900 B2
(45) Date of Patent: Jun. 14, 2005

(54) ARCHERY BOW WITH SWING ARM CABLE GUARD AND FALL-AWAY ARROW REST

(75) Inventor: Henry M. Gallops, Jr., Gainesville, FL (US)

(73) Assignee: SOP services, Inc., Las Vegas, NV (US)

( * ) Notice: Subject to any disclaimer, the term of this patent is extended or adjusted under 35 U.S.C. 154(b) by 0 days.

(21) Appl. No.: 10/687,950

(22) Filed: Oct. 17, 2003

(65) Prior Publication Data

US 2004/0134473 A1 Jul. 15, 2004

Related U.S. Application Data

(63) Continuation-in-part of application No. 10/205,388, filed on Jul. 25, 2002, now Pat. No. 6,655,371, which is a continuation-in-part of application No. 09/768,704, filed on Jan. 24, 2001, now Pat. No. 6,425,385.

(51) Int. Cl.[7] ..... F41B 5/10

(52) U.S. Cl. ..... 124/25.6; 124/44.5

(58) Field of Search ..... 124/24.1, 25.6, 124/44.5, 86, 88

(56) References Cited

U.S. PATENT DOCUMENTS

| | | | | | |
|---|---|---|---|---|---|
| 4,834,061 | A | * | 5/1989 | Chattin | 124/86 |
| 4,919,108 | A | | 4/1990 | Larson | |
| 5,365,912 | A | | 11/1994 | Pittman | |
| 5,415,154 | A | * | 5/1995 | Angeloni | 124/44.5 |
| 5,490,492 | A | | 2/1996 | Savage | |
| 5,632,263 | A | | 5/1997 | Sartain | |
| 5,718,213 | A | | 2/1998 | Gallops, Jr. et al. | |
| 6,044,832 | A | | 4/2000 | Piersons, Jr. | |
| 6,152,124 | A | | 11/2000 | Gallops, Jr. | |
| 6,178,958 | B1 | | 1/2001 | Gallops, Jr. | |
| 6,615,813 | B1 | | 9/2003 | Troncoso, Jr. et al. | |
| 6,655,371 | B2 | * | 12/2003 | Gallops, Jr. | 124/25.6 |

* cited by examiner

*Primary Examiner*—John A. Ricci
(74) *Attorney, Agent, or Firm*—Woodard, Emhardt, Moriarty, McNett & Henry LLP

(57) ABSTRACT

A compound archery bow having an adjustable cable guard. In one preferred embodiment, the cable guard includes a swing arm with an adjustable cable saver. In an alternate preferred embodiment, a compound archery bow includes a cable guard and a fall-away arrow rest assembly.

21 Claims, 10 Drawing Sheets

FIG. 4
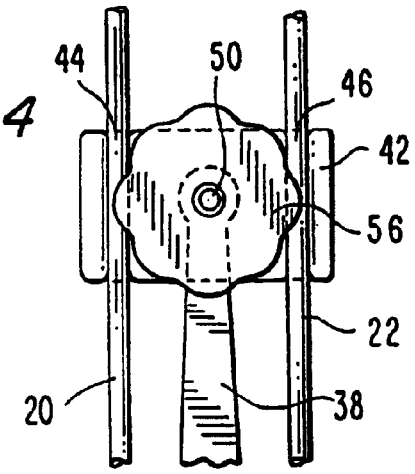
FIG. 5
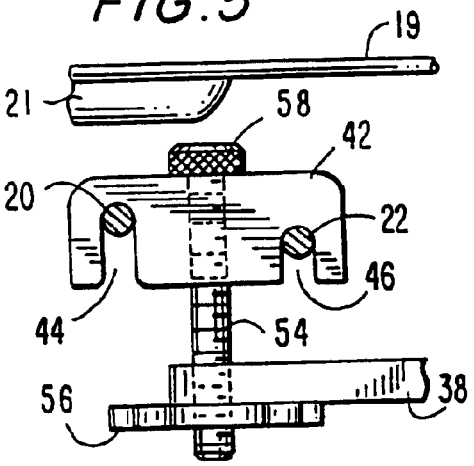
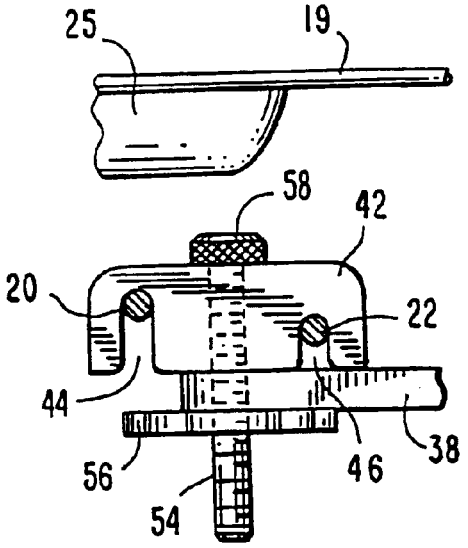
FIG. 6

ARCHERY BOW WITH SWING ARM CABLE GUARD AND FALL-AWAY ARROW REST

This application is a continuation-in-part of application Ser. No. 10/205,388 filed on Jul. 25, 2002 now U.S. Pat. No. 6,655,371, which is a continuation of application Ser. No. 09/768,704 filed on Jan. 24, 2001, now U.S. Pat. No. 6,425,385.

FIELD OF THE INVENTION

This invention is directed to an archery bow having a swing arm cable guard which is mounted to the archery bow riser. A cable saver located on the cable guard retains the cables and separates the cables and the bow string. The cable saver is adjustably mounted on the cable guard so that the distance between the cables and bow string may be varied without disassembling of the bow, to permit arrow fletchings of different sizes to pass therebetween.

BACKGROUND OF THE INVENTION

Cable guards are utilized in compound archery bows when the cable and bow string are too closely spaced laterally to permit the free passage of the fletching of an arrow therebetween. The cable guard typically includes a cable saver which separates the cables and bow string so that the arrow may pass therebetween. One such cable guard, is disclosed in U.S. Pat. No. 5,718,213 for a "Swing Arm Cable Guard". This patent discloses a cable guard including a support member and a swing arm pivotally connected thereto. The cable saver, which is referred to in the patent as a cable retaining means, has two bores for retaining the cables and is pivotally mounted on the swing arm. The angle between the support member and the swing arm is such that when the bow is drawn, the distance between the cables, which are retained in the cable saver retaining means, and the plane of the bow string travel, is less than the distance between the cables and the plane of bow string travel when the bow is at rest. Since the cables are closer to the plane of bow string travel when the bow is drawn, the cables and bow limbs are less stressed when the bow is drawn. The cable guard retaining means is not adjustable to change the distance between the cable saver and bow string, so as to allow fletchings of different sizes to pass therebetween.

Another cable guard is disclosed in U.S. Ser. No. 09/368,823 for an "Archery Bow Having an incrementally Adjustable Cable Guard". This application is directed to an incrementally adjustable cable guard whereby the distance between the cable saver and the bow string may be varied to accommodate arrow fletchings of different sizes while still permitting the free passage of the arrow being shot. However, in order to vary the distance between the cable saver and the bow string, the string and cables are removed from the cable saver; then serrated teeth on a handle portion must be properly positioned with serrated teeth on an elbow portion of a support arm to vary the distance between the cable saver and the bow string the desired amount; and thereafter the bow must be assembled to reestablish the proper tension.

The cable guard disclosed in U.S. Ser. No. 09/368,830 for an "Archery Bow Having a Side Mounted Swing Arm Cable Guard" is directed to a swing arm cable guard which is rigidly mounted on the side of the archery bow riser. The cable guard extends outwardly and upwardly from the side of the handle to the horizontal centerline of the bow. By moving the cable displacement away from the limb tips, there is less limb torque and the limbs travel straighter during the draw cycle of the bow. Shims may be provided between the riser and the cable guard to vary the distance between the riser and the cable guard to accommodate arrow fletchings of different sizes. To vary the distance between the cable saver and the bow string, the string and cables are removed from the cable saver, the proper number of shims must be installed, and the bow must be reassembled to provide the proper tension.

The patent and applications discussed above are owned by the assignee of the present invention.

SUMMARY OF THE INVENTION

The present invention is directed to an archery bow having a swing arm cable guard which is mounted on or mounted to the archery bow riser. The cable guard comprises a cable saver which controls the path of the cables to separate the cables and the bow string so that the arrow fletching may pass between the cables and the bow string when the arrow is shot. The cable saver is adjustably mounted on the cable guard so that the distance between the cables and bow string may be varied, without disassembling of the bow, to allow arrow fletchings of different sizes to pass therebetween.

An alternative preferred embodiment is directed to a bow with a cable guard and a fall-away arrow rest assembly.

It is therefore an object of the present invention to provide a cable saver on a cable guard, and wherein the cable saver may be adjusted to vary the distance between the cables and the bow string.

It is a still further object of the present invention to provide a cable saver on a cable guard and wherein the cable saver may be conveniently adjusted to vary the distance between the cables and the bow string.

It is an additional object of the present invention to provide a cable saver on a cable guard, wherein the cable saver may be conveniently adjusted to vary the distance between the cables and the bow string without having to relax the tension in the cables.

Other objects and attendant advantages of this invention will be readily appreciated as the same become better understood by references to the following detailed description when considered in connection with the accompanying drawings in which like reference numerals designate like parts throughout the figures thereof

BRIEF DESCRIPTION OF THE DRAWINGS

FIG. 4 is a side elevational view of the adjustably mounted cable saver of the present invention.

FIG. 5 is a top plan view of the adjustably mounted cable saver of the present invention in the position closest to the bow string to accommodate an arrow having a smaller fletching.

FIG. 6 is a top plan view of the adjustably mounted cable server of the present invention in a position furthest from the bow string to accommodate an arrow having a larger fletching.

DETAILED DESCRIPTION OF PREFERRED EMBODIMENTS

Figure 1:
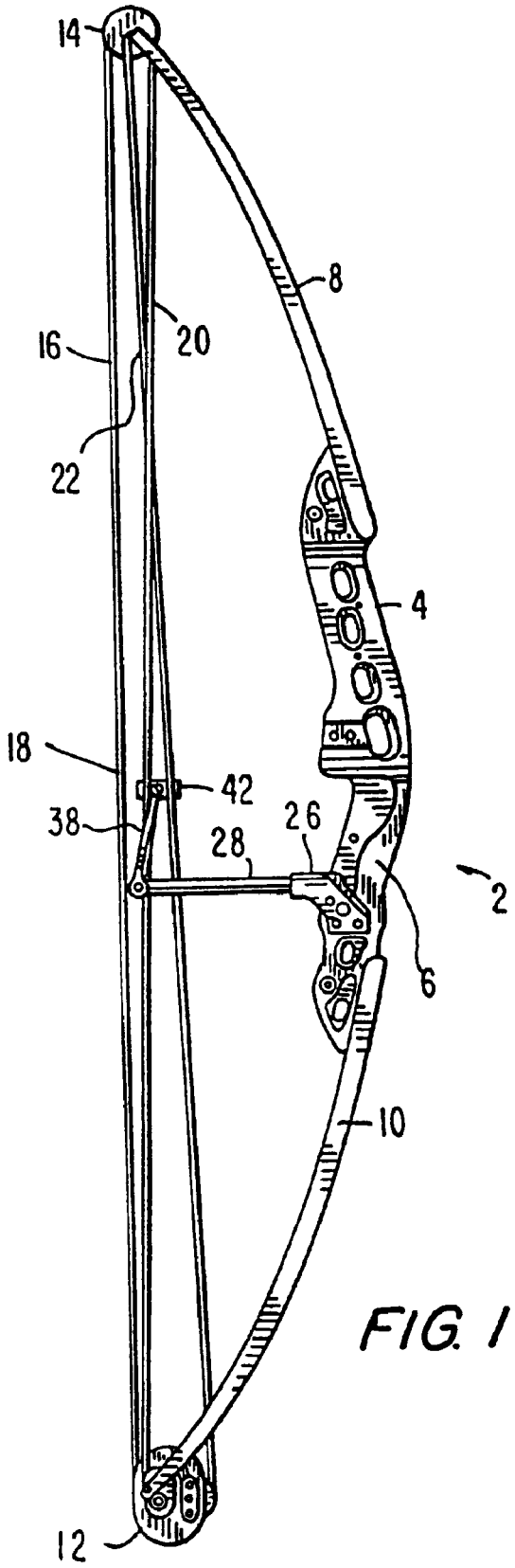
FIG. 1 is a side elevational view of an archery bow having a swing arm cable guard which includes the adjustably mounted cable saver of the present invention.

There is shown in FIG. 1 a compound archery bow 2, which includes a riser 4 having a handle portion 6. Riser 4 has flat sides and is connected at one end to an upper limb 8 and at the other end to a lower limb 10. A dual-feed cam 12 is mounted on an axial pin which extends through the bottom of lower limb 10. A concentric pulley wheel 14 is mounted on an axial pin which extends through the top of upper limb 8. While the illustrated bow is a dual-feed single-cam compound bow of the type disclosed in U.S. Pat. No. 5,368,006, it will be apparent that the cable guard of the present invention may be used with other types of compound bows.

A string has a medial portion trained around concentric pulley wheel 14 to form bow string 18 and a secondary return string 20. The ends of bow string 18 and secondary return string 20 pass around eccentric peripheral groove portions of the cam 12 and are connected to it, so that when the bow is shot, bowstring 18 and return string 20 will be fed out from cam 12. An anchor cable 22 is anchored at one end to the axle which extends through the top of upper limb 8. The other end of anchor cable 22 passes around an eccentric peripheral groove portion of cam 12 and is connected to it. In this manner, anchor cable 22 forms a direct connection between the limbs 8 and 10.

Figure 2:
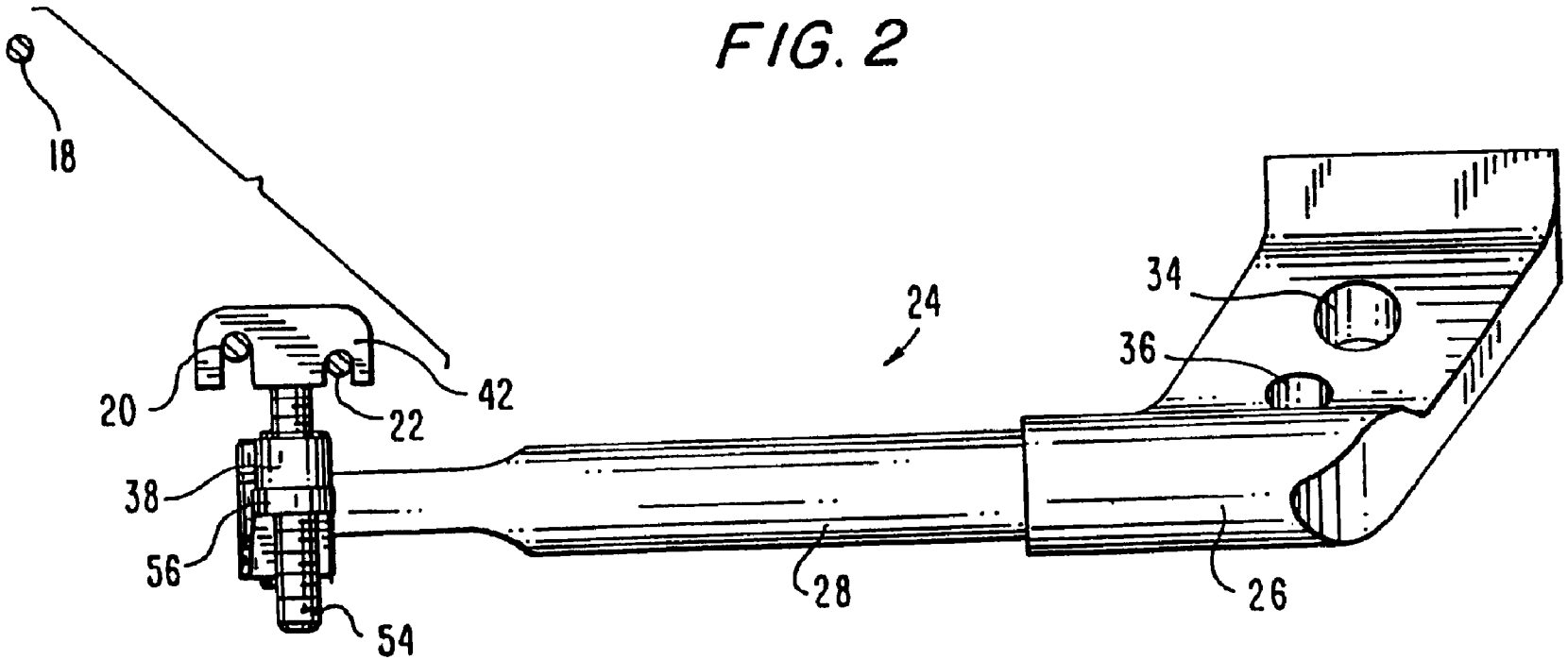
FIG. 2 is a top plan view of the swing arm cable guard having a first embodiment of the adjustably mounted cable saver of the present invention and wherein the archery bow is in the brace position.
Figure 3:
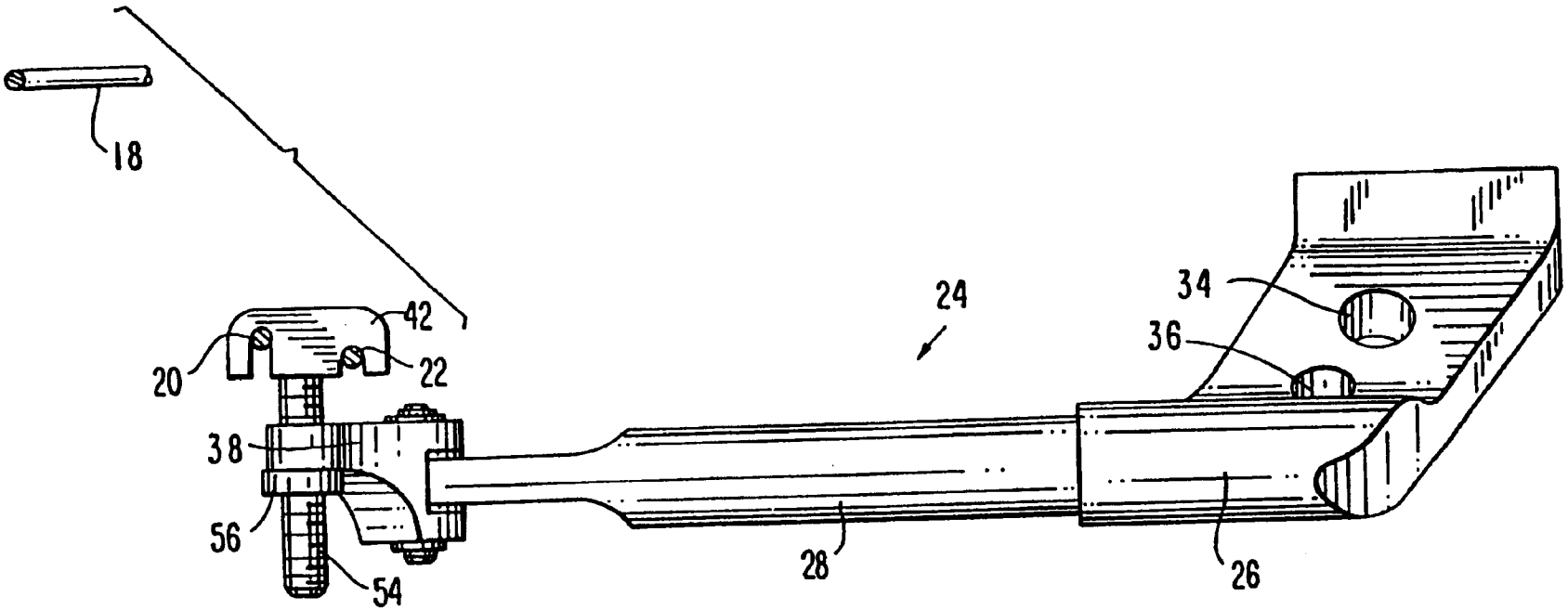
FIG. 3 is a top plan view of the swing arm cable guard of FIG. 2 when the archery bow is in the drawn position.

A cable guard 24, as seen in FIGS. 2, 3 and 4, includes an attachment portion 26, which is connected to the side of riser 4 below the handle portion 6 and an integral support arm 28. Attachment portion 26 is rigidly connected to riser 4 beneath handle 6 by conventional socket head cap screws 27. Attachment portion 26 also includes openings 34 and 36 for the purpose of reducing the weight of the cable guard. One end of a swing arm 38 is pivotally connected in an upward direction to support arm 28 at pivot end 40 and the other end of swing arm 38 has a cable retaining means, or cable saver 42 pivotally connected thereto. Cable saver 42 includes cable retaining openings 44 and 46 which retain return string 20 and anchor cable 22. As best seen in FIGS. 5 and 6, cable retaining opening 44, which is deeper than cable retaining opening 46, retains the secondary return string 20. Cable retaining opening 46 retains the anchor cable 22.

The manner in which a preferred embodiment of cable server 42 is adjustably mounted on swing arm 38 of cable guard 24 is shown in FIGS. 4 through 6. Cable saver 42 is pivotally secured on a socket head cap screw 50, having a head 58 thereon, which includes a threaded portion 54 slidable through a threaded opening in swing arm 38 and threaded in knurled knob 56. Threaded portion 54 of cable saver 42 is slidable within swing arm 38 of cable guard 24 to achieve the desired distance between the cable guard 24 and the arrow on bow string 18. The desired distance between the cable guard 24 and the arrow is dependent upon the width of the fletching of the arrow being shot. It is desired that the distance between the fletching and the secondary return string 20 and anchor cable 22 carried by cable saver 42 be as small as possible to reduce torque while permitting the fletching to pass therethrough.

In FIG. 5, the arrow 19, only the rear portion of which is shown, carried on the bow string includes a fletching 21 of relatively small width compared to the fletching 25 on arrow 23 shown in FIG. 6. Therefore, the desired distance between the cable saver 42 and the arrow 19 shown in FIG. 5 is relatively small, as compared to the distance between the cable saver 42 and the arrow 23 shown in FIG. 6. Depending on the size of the fletching of the arrow being shot, the distance between the cable saver 42 and the arrow may vary between the distances shown in FIGS. 5 and 6. The threaded portion 54 of cable saver 42 is moved within swing arm 38 of cable guard 24 until the desired distance between cable saver 42 and the arrow is achieved and the knurled knob 56 is rotated clockwise until the bottom of cable saver 42 is in contact with the top of knurled knob 56. In this manner, knurled knob 56 maintains cable saver 42 at the desired distance from the arrow on bow string 18.

Figure 3A:
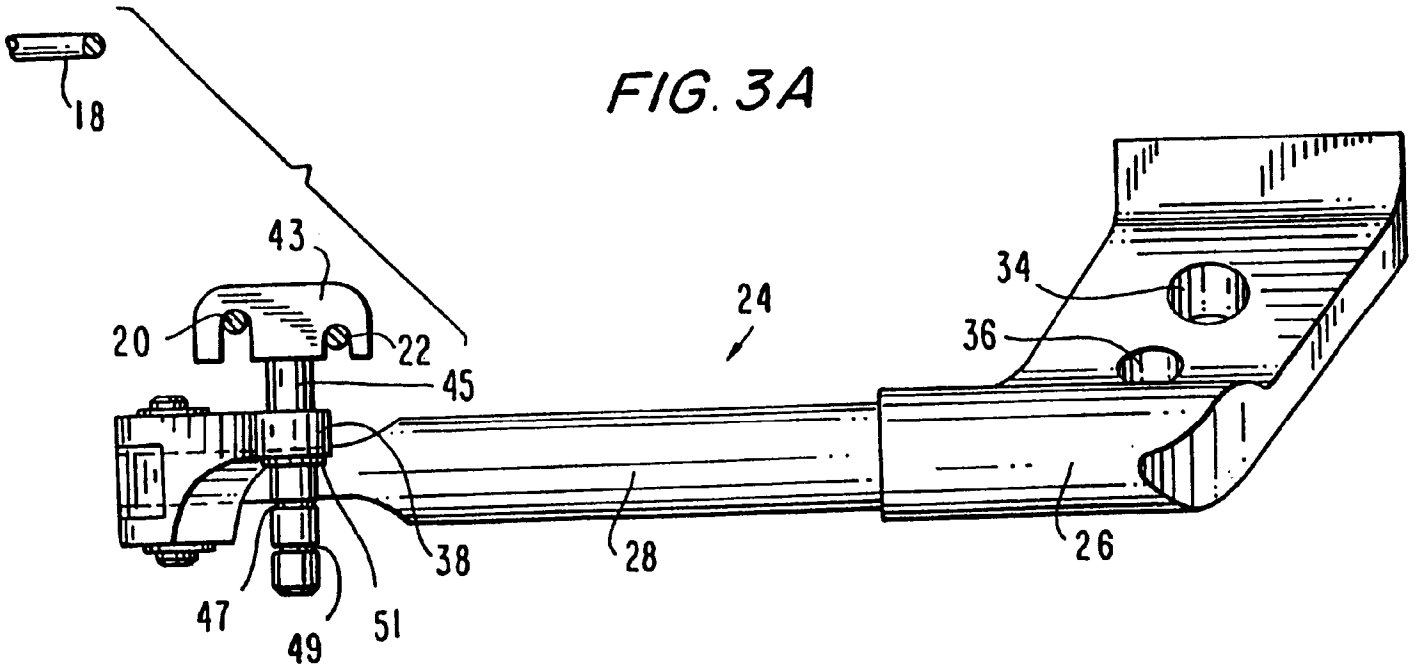
FIG. 3A is a top plan view of the swing arm cable guard having a second embodiment of the adjustably mounted cable saver of the present invention and wherein the archery bow is in the drawn position.
Figure 3B:
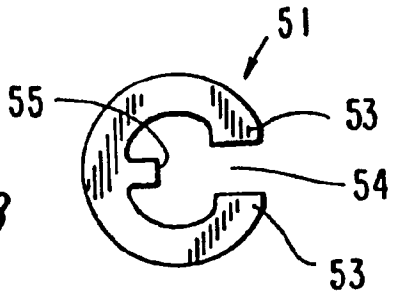
FIG. 3B is an exploded view of the e-clip used with the second embodiment of the adjustably mounted cable saver of the present invention.

In addition to the cable saver described above, there is shown in FIGS. 3A and 3B another means for adjustably mounting the cable saver 42 on the swing arm 38. In this embodiment, cable saver 43 includes a shank 45 having three spaced annular grooves therein. Two of the groves, 47 and 49, are shown in FIG. 3A and the third groove, located above grooves 47 and 49, is not visible because an e-clip 51 is mounted thereon. The shank 45 of cable saver 43 is slidable within the swing arm 38 of cable guard 24 to achieve the desired distance between the cable saver 43 and the arrow.

An e-clip 51 includes spring fingers 53 having an opening 54 therebetween which is slightly smaller than the thickness of the annular grooves. To mount the e-clip 51 on an annular groove, the spring fingers 53 are spread apart and placed around the annular groove and then released. When released the spring fingers 53 are in biased engagement with the annular grooves, and lug 55 of e-clip 51 is in frictional contact with the opposite side of the annular groove. Thus, e-clip 51 is maintained in an annular groove by contact of the spring fingers 53 and lug 55 against the annular groove.

It will be appreciated that, after the shank 45 of cable saver 43 is moved within the swing arm 38 of cable guard 24 to the desired distance, e-clip 51 is selectively mounted in the corresponding annular groove (i.e. the groove closest to the position of the bottom of cable saver 43). The bottom of cable saver 43 is in contact with the top of e-clip 51 to maintain the cable saver 43 at a fixed distance from the arrow on the bow string 18. The distance between the cable saver 43 and the bow string 18 will depend on which annular groove is selected to mount the e-clip 51. Thus, if the annular groove selected is that indicated in FIG. 3A, (i.e., the uppermost groove) the fixed distance between the cable saver 43 and the on arrow bow string 18 will be the greatest.

This is the distance desired when the arrow fletching is of large width. On the other hand, if the annular groove 49 is selected for mounting e-clip 51, the fixed distance between the cable saver 43 and the bow string 18 will be the least. If annular groove 47 is selected for mounting e-clip 51, then the distance between the cable server 43 and the arrow on bow string 18 will be intermediate these two previously discussed distances.

Figure 7:
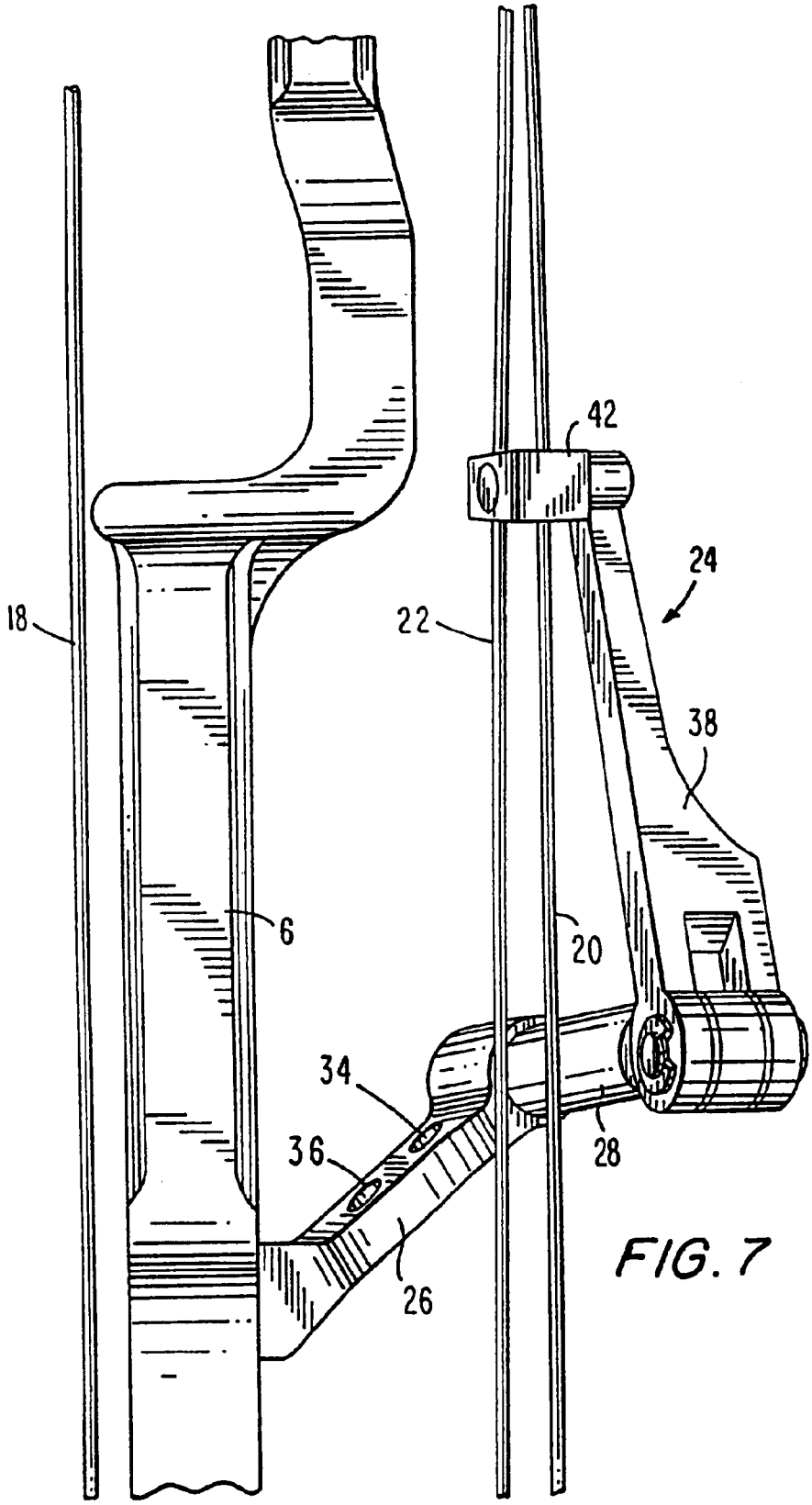
FIG. 7 is a rear elevational view, as viewed by the archer, of the archery bow riser having the swing arm cable guard mounted thereon.

As seen in FIG. 7 attachment portion 26 of cable guard 24 extends outwardly and upwardly from riser 4 to the centerline of the bow. As a result of the upward position of attachment portion 26, and the upward direction of swing arm 38, cable retaining means 42 is also closer to the horizontal centerline of the bow or, stated otherwise, cable retaining means 42 is further from the tips of upper limb 8 and lower limb 10. Therefore, the position at which the return string 20 and anchor cable 22 are displaced by the cable retaining means will be further from the tips of upper limb 8 and lower limb 10 and there will be less torque on the limbs when the arrow is shot. As a result, the limbs will travel straighter during the draw cycle of the bow and the shot will be more accurate.

Figure 8:
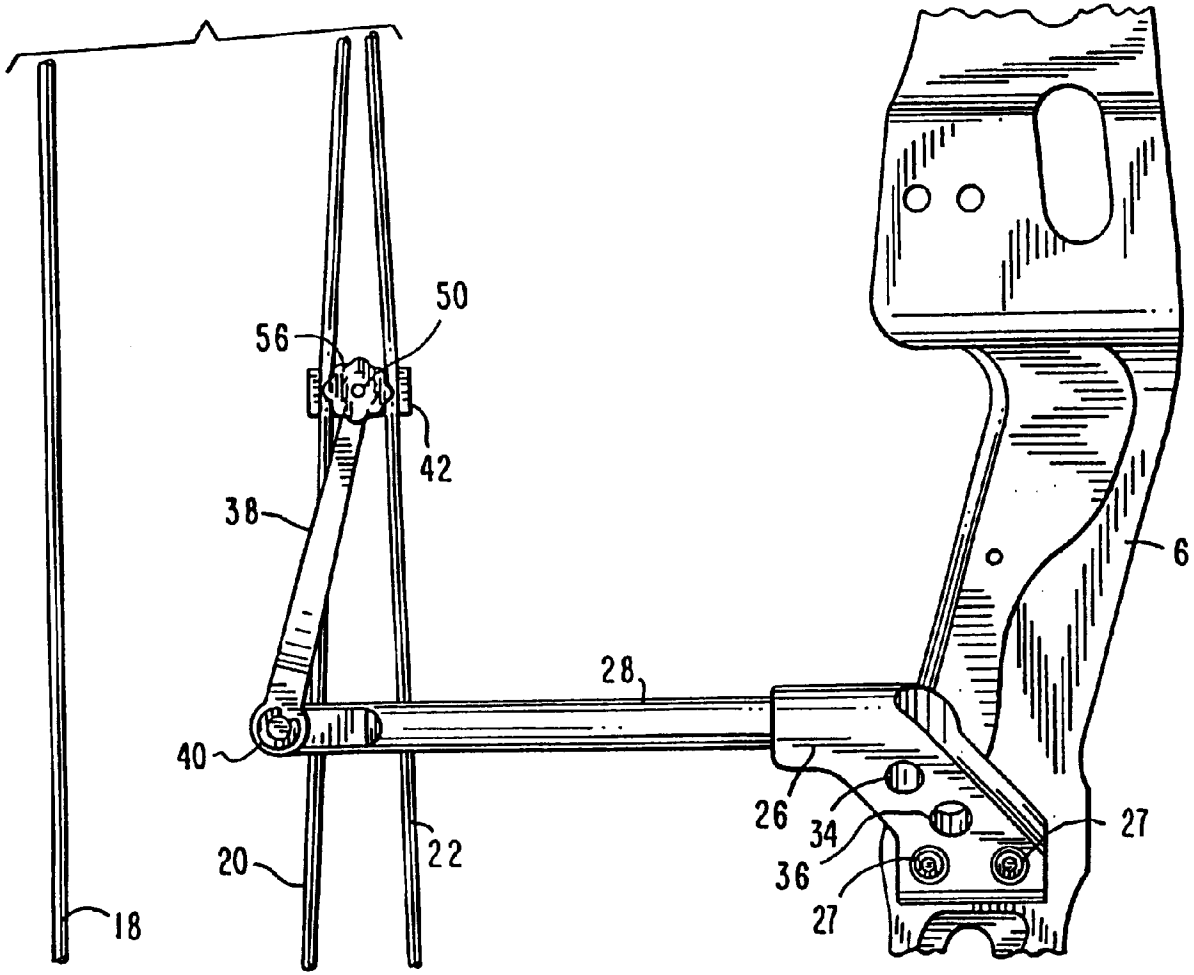
FIG. 8 is a left side elevational view of the riser and swing arm cable guard shown in FIG. 7 when the archery bow is in the brace position
Figure 9:
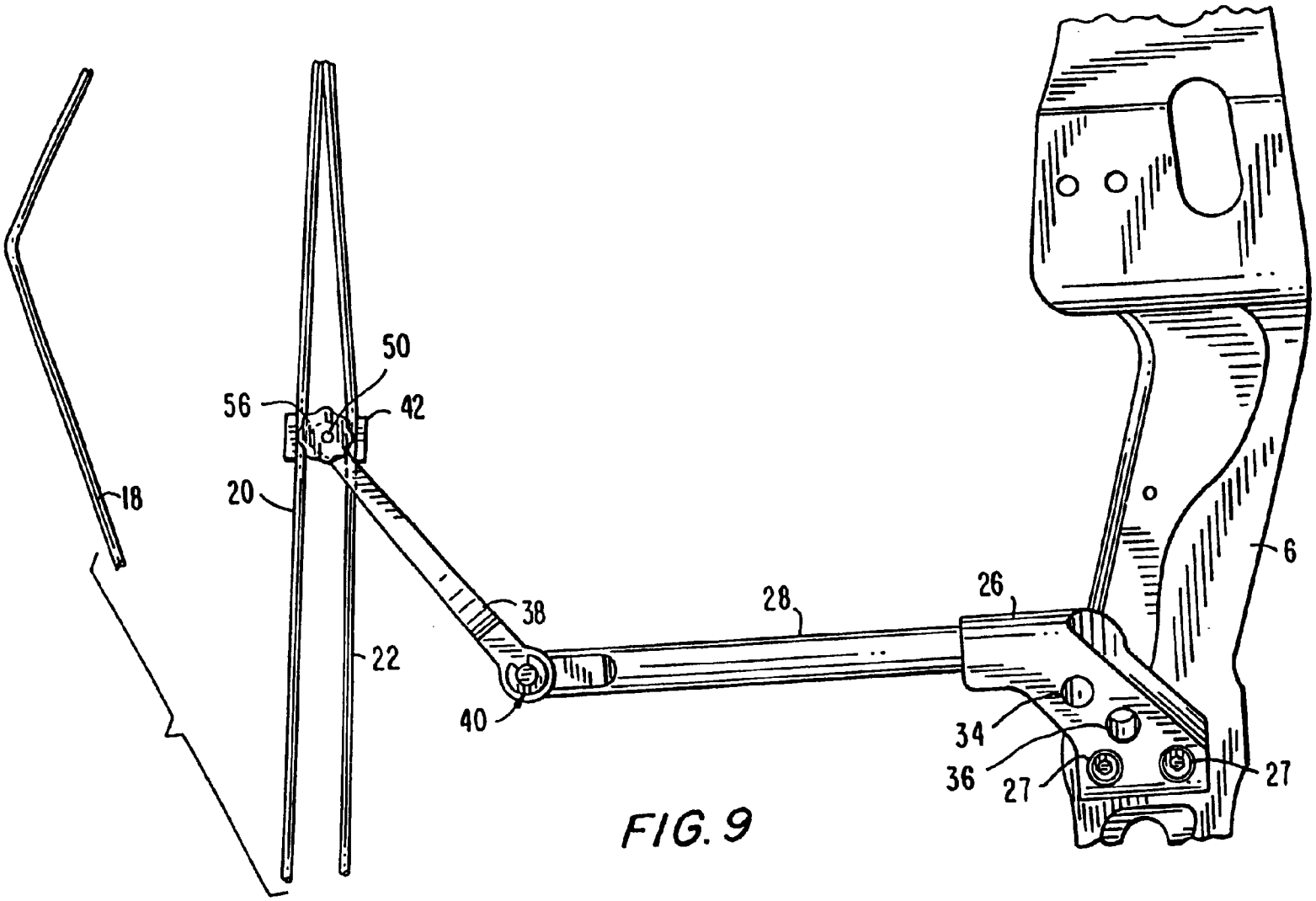
FIG. 9 is a left side elevational view of the riser and swing arm cable guard shown in FIG. 7 when the archery bow is in the drawn position.

The operation of cable guard 24 can be seen in FIG. 8 wherein the bow is in the brace position and FIG. 9 wherein the bow is in the drawn position. When bow string 18 is drawn, string 20 and cable 22 move in the direction of bow string 18 as swing arm 38, having cable retaining means 42 thereon, is caused to be pivoted counter-clockwise to the positions shown in FIG. 9. After the shot, swing arm 38 pivots clockwise to return to the brace position shown in FIG. 8.

Figure 10:
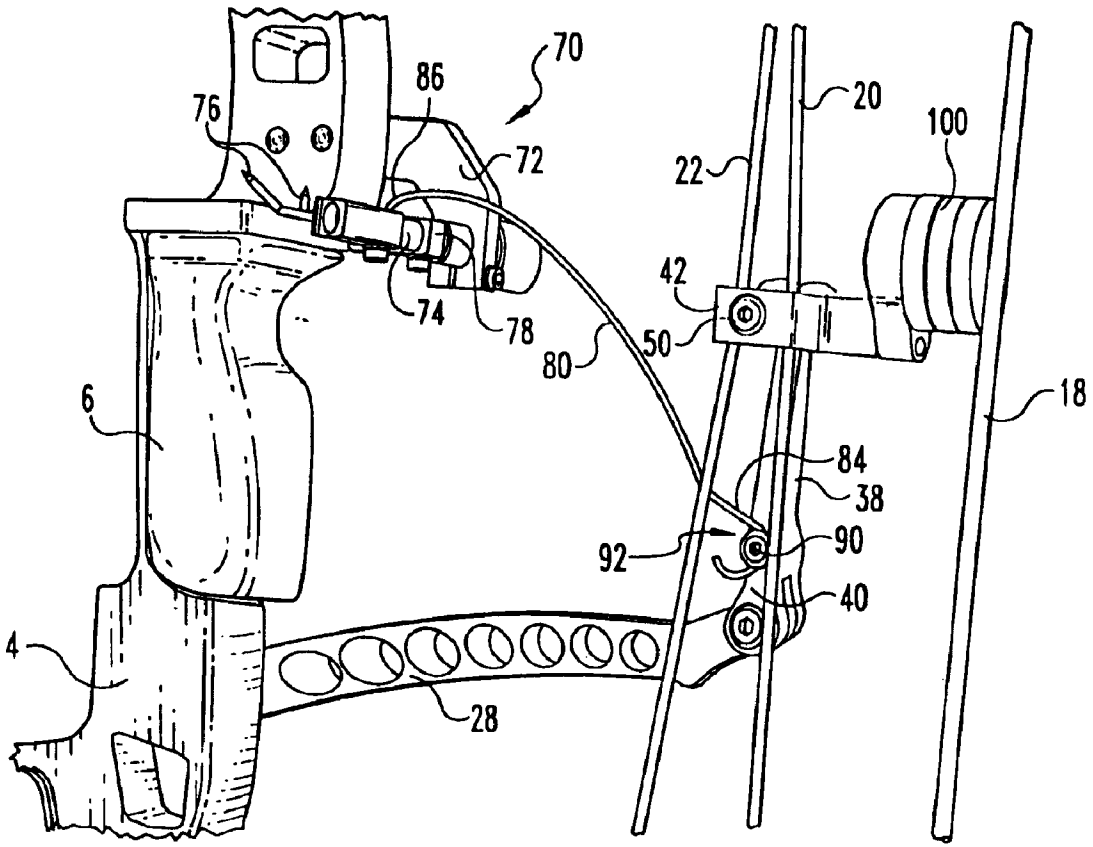
FIG. 10 is a perspective view of a riser section in an alternate preferred embodiment with a cable guard and fall-away arrow rest when the archery bow is in the brace position.
Figure 11:
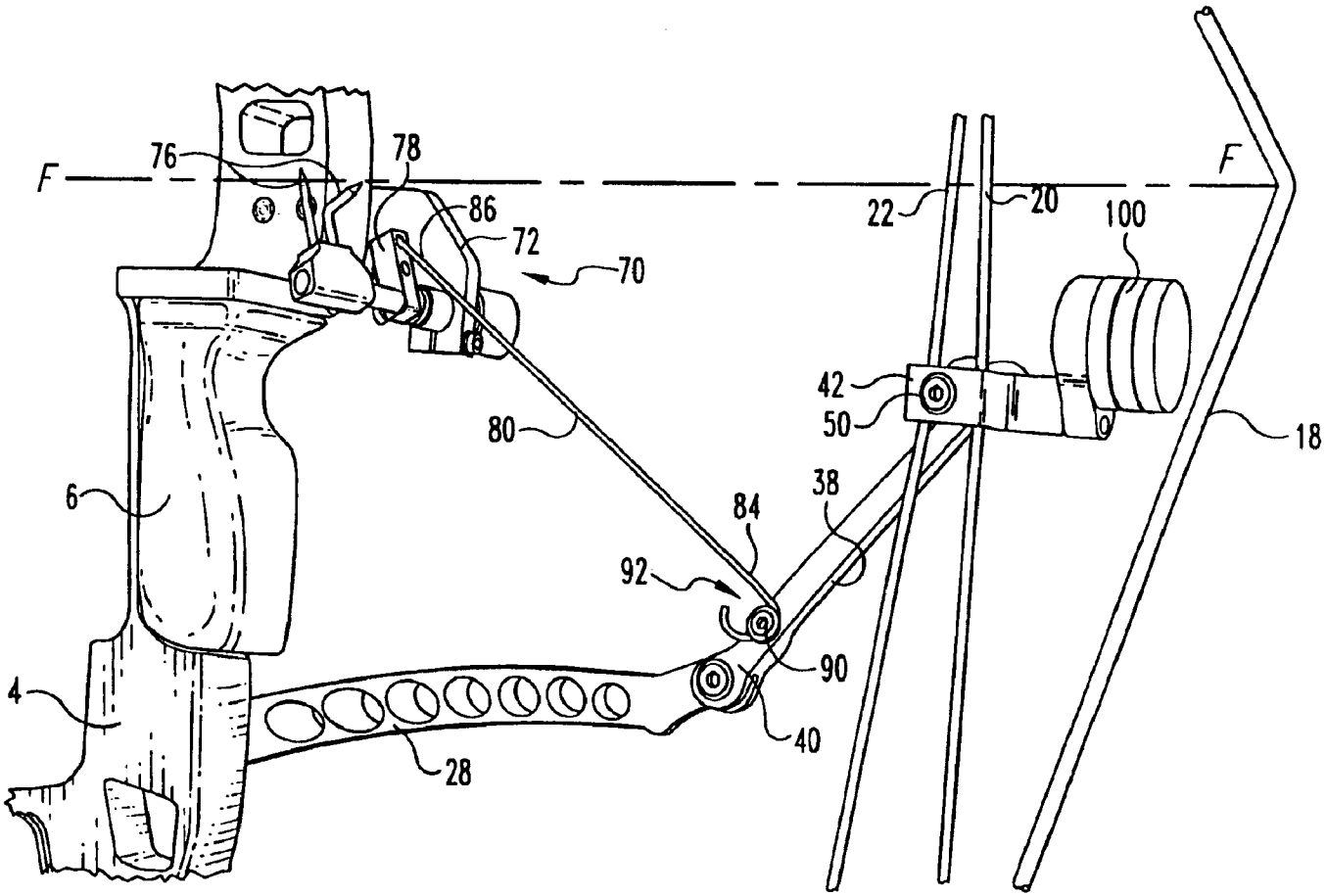
FIG. 11 is a perspective view of the embodiment of FIG. 10 when the archery bow is in the drawn position.

A further preferred embodiment, illustrated in FIGS. 10 and 11, shows in combination a bow with a swing arm cable guard and a fall-away arrow rest. The basic bow is one as described herein having a riser portion 4 with handle 6. Bow string 18 has a return cable 20 and an anchoring cable 22 retained by a cable guard 42 with a threaded fastener 50 on swing arm 38. The pivot end 40 of the swing arm 38 is pivotally connected to an attachment member 28 mounted to and extending from riser 4. In the illustrated embodiment, the cable guard optionally includes string vibration dampener 100.

In the illustrated preferred embodiment, a fall-away arrow rest assembly 70 is mounted to riser 4 using bracket arm 72. Arrow support arms 76 are coupled to pivot member 74 which is pivotally mounted to bracket arm 72. Preferably support arms 76 are biased to a down position, for example with a spring. Pivot member 74 includes a cable connection point such as bell crank bracket 78. Cable 80 extends from a mounting point on the arrow rest assembly, such as bracket 78, to an opposing mounting point on swing arm 40. The word cable is used broadly to include a wire, metal, cable, string, strand braid or similar material which transmits a pulling force when the bow is extended and is releasable to provide slack when the bow is released. In one preferred embodiment, the arrow rest end 86 of cable 80 is connected to the bell crank bracket 78 of the arrow rest, and the opposing end portion 84 of cable 80 is connected to the mounting point on swing arm 40. Although reference is made to the ends of cable 80 herein, it is understood to include cable segments either adjacent the end or functioning as an end portion along the cable's length for purposes of the invention, even though additional cable length may extend past the mounting position.

In one preferred embodiment, opposing end 84 of cable 80 is mounted to swing arm 40 using a cam screw 90. Cam screw 90 is received within a pretapped bore 92 in swing arm 40. Appropriate threading is well known in the industry, and in a preferred embodiment a 6-32 tapped hole is used. Cam screw 90 preferably includes a sufficiently wide cap head to clamp the end or a portion of cable 80 securely between the cam screw head and swing arm 40. In one embodiment, the preferred length between the swing arm and the arrow rest assembly may be adjusted by loosening cam screw 90, adjusting the cable to the desired length between the arrow rest assembly and the swing arm, and re-tightening the cam screw.

In operation, at a rest or braced position (FIG. 10), bow string 18 is in its rest configuration along with swing arm 40, and arrow support arms 76 are in the lowered position to which they are biased. As bow string 18 and the bow are drawn to a full position (FIG. 11), the last few inches of draw preferably cause swing arm 40 to rotate away from the riser, concurrently pulling cable 80. The pull on cable 80 causes the support arms 76 to pivot to a vertical position, raising an arrow (not shown) to a position above handle 6 and aligning the arrow with the desired flight path F. When string 18 is released, it retracts forward to propel the arrow, as is well known, wherein swing arm 40 pivots toward riser 4 and the slack in cable 80 allows the arrow support arm 76 to fall or return to a horizontal or rest position.

Having thus described the invention, it will be apparent to those skilled in the art that various modifications can be made within the scope of the invention. It is therefore understood that the present invention may be practiced otherwise than as specifically described.

What is claimed is:

1. A compound archery bow comprising a cable guard, a bow string, a riser having sides and a handle portion, a pair of bow limbs, and a fall-away arrow rest assembly, said cable guard including a cable saver for retaining a secondary return string and an anchor cable, and wherein the cable saver is adjustably mounted on said cable guard for movement to and from the bow string.

2. The compound archery bow of claim 1, wherein said cable saver comprises a threaded adjustment mechanism for moving said cable guard to and from the bow string.

3. The compound archery bow of claim 2, wherein said adjustment mechanism comprises a threaded screw and knob which selectively maintains said cable saver in a fixed position relative to the bow string.

4. The compound archery bow of claim 1, further comprising a cable coupled between said fall-away arrow rest assembly and said cable guard.

5. The compound archery bow of claim 4, wherein said cable guard comprises a swing arm, and wherein said cable is coupled to said swing arm.

6. The compound archery bow of claim 5, wherein said swing arm is pivotally mounted to an attachment portion extending from said riser.

7. A compound archery bow comprising, a bow string, a riser having sides and a handle portion, a pair of bow limbs, a fall-away arrow rest assembly, a cable guard, wherein said cable guard includes a swing arm pivotally mounted to a portion extending from said riser, and a cable extending from said fall-away arrow rest assembly to said swing arm.

8. The compound archery bow of claim 7, wherein said swing arm includes a mounting location for selectively securing said cable to said swing arm at a location along said cable's length.

9. The compound archery bow of claim 7, wherein said swing arm pivots away from said riser and pulls said cable when the bowstring is drawn, and wherein pulling said cable causes an arrow support of said fall-away arrow rest assembly to rise to be aligned with a desired arrow flight path.

10. The compound archery bow of claim 9, wherein said swing arm pivots toward said riser when the bowstring is released, allowing slack in said cable, and wherein slack in said cable allows said arrow support of said fall-away arrow rest assembly to fall away.

11. The compound archery bow of claim 9, wherein said arrow support is biased to fall away from the desired arrow flight path.

12. A compound archery bow, comprising, a) a cable guard, a bow string, a riser, and a pair of bow limbs attached to said riser;

b) a fall-away arrow rest assembly associated with said riser;

c) said cable guard including:

i) a swing arm pivotally associated with said riser and ii) a cable saver mounted on said swing arm for retaining a secondary return string and an anchor cable, wherein the cable saver is adjustably mounted on said swing arm for movement to and from the bow string; and, d) said swing arm including a mounting location for attachment of a cable extending from said fall-away arrow rest assembly.

13. The compound archery bow of claim 12, wherein said mounting location allows one end of the cable to be attached to said swing arm at the cable end.

14. The compound archery bow of claim 12, wherein said mounting location allows a portion adjacent one end of the cable to be secured to said swing arm.

15. The compound archery bow of claim 12, wherein said mounting location allows the cable to be selectively secured to said swing arm at a location along the length of said cable.

16. A cable guard attachable to a compound archery bow having a bow string comprising, a cable saver for retaining a secondary return string and an anchor cable; wherein said cable saver is adjustably mounted on said cable guard for movement to and from the bow string.

17. The cable guard of claim 16, wherein said cable saver comprises a threaded adjustment mechanism for moving said cable guard to and from the bow string.

18. The cable guard of claim 17, wherein said threaded adjustment mechanism comprises a knurled knob.

19. The cable guard of claim 16, comprising a swing arm upon which said cable saver is mounted.

20. The cable guard of claim 19, comprising an attachment member configured to be attached to a bow riser of the bow, and wherein said swing arm is pivotally mounted to a said attachment member.

21. The cable guard of claim 16, wherein said cable guard is configured to be coupled to an arrow rest assembly on the bow.

* * * * *